US005767889A

United States Patent [19]

Ackley

[11] Patent Number: 5,767,889

[45] Date of Patent: Jun. 16, 1998

[54] BAR SHAVING OF THE RESIDENT FONTS IN AN ON-DEMAND BARCODE PRINTER

[75] Inventor: H. Sprague Ackley, Seattle, Wash.

[73] Assignee: Intermec Corporation, Everett, Wash.

[21] Appl. No.: 518,503

[22] Filed: Aug. 23, 1995

[51] Int. Cl.[6] ..... B41J 2/315; B41J 2/32; B41J 2/60

[52] U.S. Cl. ..... 347/171; 347/107; 400/103; 395/151

[58] Field of Search ..... 347/107, 171; 358/296; 235/462, 463; 346/62; 364/237.85; 382/100; 400/103; 395/151

[56] References Cited

U.S. PATENT DOCUMENTS

| | | | |
|---|---|---|---|
| 3,975,707 | 8/1976 | Ito et al. | 347/190 |
| 4,567,488 | 1/1986 | Moriguchi et al. | 347/196 |
| 4,795,281 | 1/1989 | Ulinski, Sr. et al. | 400/74 |
| 4,824,266 | 4/1989 | Fujii et al. | 400/103 |
| 4,864,112 | 9/1989 | Imai et al. | 235/463 |
| 4,870,428 | 9/1989 | Kuwabara et al. | 347/195 |
| 4,937,590 | 6/1990 | Robillard et al. | 347/183 |
| 5,007,748 | 4/1991 | Lee et al. | 400/103 |
| 5,023,437 | 6/1991 | Speicher | 235/432 |
| 5,056,429 | 10/1991 | Hirosaki | 101/93.01 |
| 5,183,343 | 2/1993 | Tazawa et al. | 400/103 |
| 5,676,473 | 10/1997 | Wright, IV et al. | 400/103 |
| 5,681,120 | 10/1997 | Ackley | 400/103 |

FOREIGN PATENT DOCUMENTS

| | | |
|---|---|---|
| 0 329 369 | 8/1989 | European Pat. Off. . |
| 60-73852 | 4/1985 | Japan . |
| 61-22960 | 1/1986 | Japan . |
| 2 228 450 | 8/1990 | United Kingdom . |

OTHER PUBLICATIONS

Bassetti, L.W., and S. Kantor, "Print Enhancement for Laser Printers," *IBM Technical Disclosure Bulletin* 27(5): pp. 3071–3072, Oct. 1984.

*Primary Examiner*—N. Le
*Assistant Examiner*—L. Anderson
*Attorney, Agent, or Firm*—Seed and Berry LLP

[57] ABSTRACT

A method and associated apparatus for printing font character bars comprised of a plurality of rows which are in turn comprised of a plurality of close adjacent dots to improve print quality and readability thereof by optical reading apparatus while increasing potential print speeds. The basic method comprises removing a portion of one dot or more from an end of each of the plurality of rows of a character bar which is too wide for optimal reading by optical reading apparatus. Alternative methods and apparatus for automatically adjusting the fonts and printing temperature of a thermal printhead as a function of system parameters are also disclosed.

24 Claims, 5 Drawing Sheets

BAR SHAVING OF THE RESIDENT FONTS IN AN ON-DEMAND BARCODE PRINTER

BACKGROUND OF THE INVENTION

1. Technical Field

This invention relates to barcode printers and, more particularly, to a method of printing font character bars comprised of a plurality of rows which are in turn comprised of a plurality of close adjacent dots to prevent mis-reading thereof by optical reading apparatus comprising the step of removing a portion of one dot or more from an end of each of the plurality of rows of a character bar whereby the reading thereof by optical or other reading apparatus is improved.

2. Background Art

Barcode readers are a part of everyday life. Practically every retail point of sale employs a scanning device to read a barcode of the inventory identification number of products. With the inventory identification number, the product's price can be determined and the inventory automatically adjusted by the computer controlling the system.

Barcodes on products, badges, and the like, are of two types—pre-printed and on-demand printed. The pre-printed barcodes offer few problems of the type we are concerned with here. The printer is adjusted at the factory or printing establishment to provide barcodes which are most easily read by the optical barcode readers at the retail level. On-demand printers are another story. As depicted in FIG. 1, on-demand barcode printers typically employ a thermal printhead 10 to print the barcodes on a media. As depicted in FIG. 2, the printhead 10 comprises a series of adjacent thermal elements 12 that print the pixels or dots on the surface of the media. The media can have a thermally activated surface which turns dark when subjected to heat or there can be a "ribbon" of "ink" which is transferred to and fused to the surface of the media by heat. In either case, a dot 14 is created as depicted in FIG. 3.

By selectively heating the various thermal elements 12 in the printhead 10 as the media passes beneath it, a series of narrow bars 16 and wide bars 18 separated by wide and narrow spaces 20 are created as depicted in FIG. 4. The bars 16, 18 and spaces 20 are created in pre-established patterns which define the barcodes which contain the desired information.

The problem is a result of the difference between the human eye and the optical scanning apparatus that reads the barcodes. That is, a configuration of the bars 16, 18 as depicted in FIG. 4, which is optimally readable by the scanner, may appear too thin and weak to a human view. As a result, the user when making barcodes on-demand may turn up the current to the thermal elements 12 so that the bars 16, 18 look dark enough to him/her as depicted in FIG. 5. The wider bars 16', 18' of FIG. 5 are a result of "thermal bleed". The thermal elements 12 become hotter and/or stay hotter longer. Thus, the heat generated is no longer located to the immediate area under the thermal element 12 to produce a "normal" dot 14 as in FIG. 3. Rather, the heat bleeds outward radially around the dot 14 to create a dot 14 with a bigger area as a result of a "blooming" effect in the printing process. The effect of this on the reader is depicted in simplified form in FIG. 6. To read the bars 16 and 16', light 22 from an optical scanning system is scanned across the bars 16, 16'. While some of the light 22 is reflected by the surface of the media 24, a portion of the light 22 is actually absorbed into the surface of the media 24. When scanning the "normal" bar 16, the light 22 which is not reflected as a result of the non-reflective bar 16 is such as to allow the logic doing the evaluation and decoding (not shown) to optimally determine boundaries and width of the bar 16 and its adjoining space 20. By contrast, the wider bar 16' has increased width edges which trap light 22 which normally would have been reflected. This creates a "gray" area along the edges which can interfere with recognition of the bar 16' and adjoining spaces 20. The bars may appear wider and the spaces appear narrower to the scanning apparatus. It has been documented by testing that in carbon-based printing systems, for example, the bars look bigger to a scanner than to the naked eye by as much as 20%. As a result, the logic may make mistakes in decoding.

Unfortunately, other factors sometimes make increased printing temperatures a requirement. That is, the problem cannot be solved by simply warning users not to adjust printhead temperatures according to what looks good to them. For example, poorer quality media requires higher temperatures in order to produce adequate adhesion of the "ink" to the media and prevent flaking off of the printed bar code.

Other prior art dot-oriented printing systems such as dot matrix impact printers have similar problems such as dot smear. Thus, it would be advantageous if a way could be found to employ a similar approach to solve the above-described, and other, problems of on-demand barcode printers. It would be a further benefit if such improvements to printing were adaptable to other non-impact printers such as inkjet printers, and the like.

Another factor in label printers is speed. Ideally, a label printer is low cost, high speed, and capable of producing high print quality. Since print quality is the primary factor followed by cost, speed is the factor that may have to be sacrificed.

Wherefore, it is an object of the present invention to provide a way in which on-demand thermal barcode printers can be prevented from producing error-prone barcode when the power to the printhead is increased to produce bars which appear more acceptable to a human operator.

It is another object of the present invention to provide a way to reduce barcode width increase as a result of increases in thermal printhead power in on-demand thermal barcode printers.

It is still another object of the present invention to provide a way in which on-demand thermal barcode printers can be made to produce optimum barcodes automatically as a function of various system parameters.

It is yet another object of the present invention to provide a way to manufacture a thermal barcode printer which produces high print quality barcodes at low cost and with high printing speed.

Other objects and benefits of this invention will become apparent from the description which follows hereinafter when read in conjunction with the drawing figures which accompany it.

SUMMARY

The foregoing objects have been achieved by the barcode printer of the present invention for printing barcode character bars comprised of a plurality of rows which are in turn comprised of a plurality of close adjacent dots to prevent poor reading thereof by optical reading apparatus comprising, a thermal printhead including a plurality of thermal print elements for printing barcode characters on a media surface; a temperature controller having an input for receiving character-producing commands and an output connected to the thermal printhead for outputting temperature-producing signals to relevant ones of the plurality of thermal print elements; and, print logic for outputting character print signals to the input of the temperature controller, the print logic including logic for shaving a portion of one dot or more from a same end of each of the plurality of rows of a character bar which is too wide for optimal reading by optical reading apparatus.

Preferably, the logic outputs character print signals eliminating a last dot from each of the plurality of rows of a character bar which is too wide for optimal reading by optical reading apparatus.

In one automated embodiment, there is circuitry monitoring a temperature-producing signal into the printhead; and, logic for removing a portion of one dot or more from a same end of each of the plurality of rows of all character bars when the temperature-producing signal is above a threshold level indicating that bars too wide for optimal reading by optical reading apparatus are being printed by the printhead.

In another automated embodiment, there is a scanner optically scanning optical read quality of barcodes being printed by the printhead; and, logic for removing a portion of one dot or more from a same end of each of the plurality of rows of all character bars when barcodes with bars too wide for optimal reading by optical reading apparatus are being printed by the printhead.

In still another automated embodiment, there is an input to the logic receiving indications of system variables which influence print quality of barcodes being produced by the printhead; and, logic for removing a portion of one dot or more from a same end of each of the plurality of rows of all bars when barcode bars too wide for optimal reading by optical reading apparatus are being printed by the printhead as a result of the system variables. That embodiment may also include logic for modifying temperature-producing signals to the printhead as a function of the system variables indications being received.

The preferred approach to shaving the bars comprises a table of barcode descriptors for normal barcodes and barcodes with one less dot per row in the bars thereof; and, logic for using the descriptors for the normal barcodes when the character bars are not too wide and for using the descriptors for the barcodes with one less dot per row when the character bars are too wide.

DESCRIPTION OF THE PREFERRED EMBODIMENT

The foregoing objects of the present invention have been achieved by "shaving" the bars when necessary. That is, by generating barcode fonts which differ by the number of "dots" that are turned on for each bar when compared to current fonts. This adjustment is based on known printing parameters such as print speed, symbol orientation, media sensitivity, and printhead temperature.

While the example described hereinafter is with respect to a thermal barcode printer, those of ordinary skill in the art will readily recognize and appreciate that the techniques of the present invention are applicable to any barcode printer printing barcodes as a plurality of horizontal adjacent rows of multiple adjacent dots. Similarly, while a simple linear barcode is used in the examples, it is for ease of understanding and simplicity of the drawings only. The present invention can be used with any type of barcode, including linear, stacked, and matrix.

With regard to the manner and apparatus for effecting the shaving of "bars" or their equivalent in the particular barcode of interest, reference is made to a currently pending application by the inventor herein entitled DOT PRINTERS WITH WIDTH COMPRESSION CAPABILITIES filed on Aug. 23, 1995 as Ser. No. 08/518,226 and assigned to the common assignee of this invention, the teachings of which are incorporated herein by reference. As will be seen from a reference thereto, the objects of the present invention can be attained by removing an entire column of dots from the barcode definition or by designating the column of dots to be "shaved" which is then accomplished at print time by moving the dot printing position by half its normal distance thereby causing adjacent dots to be overlapped, which yields a reduced two adjacent dot width.

Figure 1:
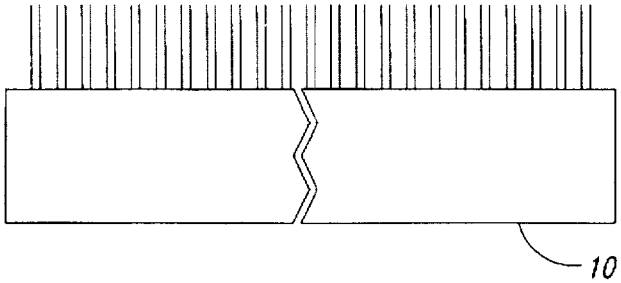
FIG. 1 is a simplified front view of a thermal printhead as employed in a barcode printer as wherein the present invention is employed.
Figure 2:
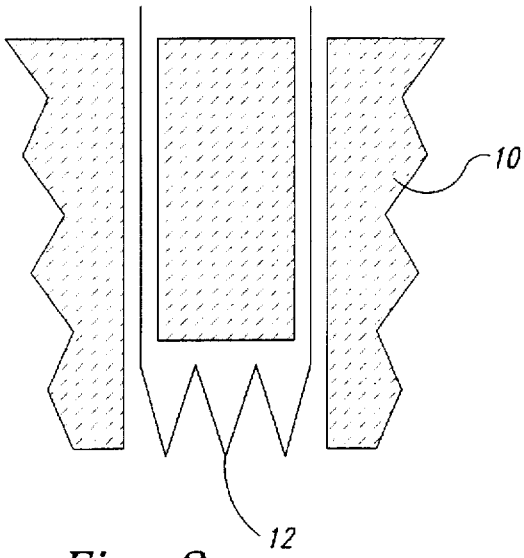
FIG. 2 is a simplified cutaway drawing of a thermal element in the printhead of FIG. 1 which "prints" one pixel position.
Figure 3:
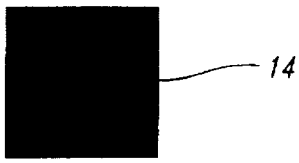
FIG. 3 is a simplified drawing of one pixel or "dot" as printed by the thermal element of FIG. 2 under ideal conditions.
Figure 4:
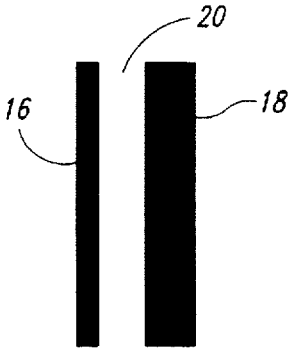
FIG. 4 is a simplified drawing of one narrow bar and one wide bar as employed in a typical barcode.
Figure 5:
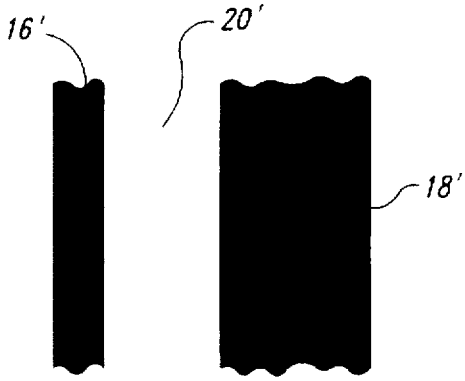
FIG. 5 is a simplified drawing of what happens to the bars of FIG. 4 when the thermal printing temperature is increased to make the bars more appealing to the eye of viewers.
Figure 6:
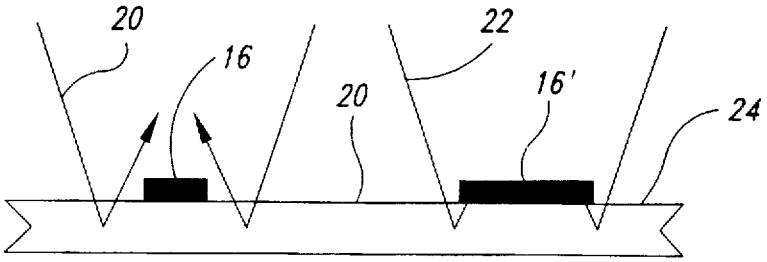
FIG. 6 is a simplified sideview drawing of the bars of FIG. 5 depicting why bars with "eye appeal" may become unreadable or more subject to poor reading when viewed by optical scanning apparatus.
Figure 7:
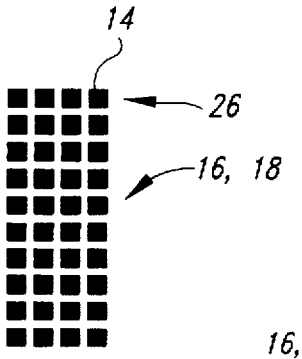
Fig. 7 (PRIOR ART)
FIG. 7 is a simplified enlarged drawing of a bar printed according to prior art techniques.
Figure 8:
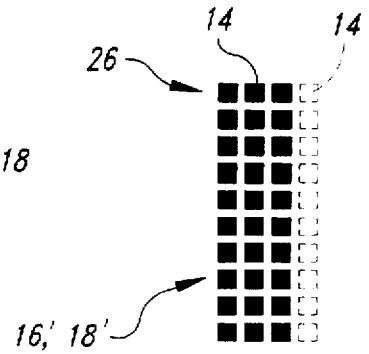
FIG. 8 is a simplified enlarged drawing of a bar printed according to the present invention with a row of pixels "shaved" off to prevent the problem of FIG. 6.

As depicted in FIG. 7, a "bar" 16, 18 is typically formed of a plurality of horizontal rows 26 of multiple dots 14. According to the present invention, when the width of a bar 16, 18 becomes too wide (or will become too wide if printed under present conditions), the width is reduced by shaving (i.e. eliminating) a portion of a dot 14, one dot 14, or more, from each row 26. From tests to date, it has been found that most common problems as described above can be virtually eliminated by simply shaving one dot 14 from each row 26 as depicted in the bar 16',18' of FIG. 8. Thus, the removal of one dot 14 is the preferred approach since the removal of dot portions requires the use of a half-stepping mode which, in turn, may cut down on printer speed. In higher resolution printers, it may be found that two, three, or more dots 14 should be removed for optimum print quality.

While the font to be used can be designed by the user and the use of such a basic approach of selecting a shaved font when applicable is to be included within the scope and spirit of the patent coverage afforded the present invention, in modern label printers a more automated approach is preferred. Several automated font shaving systems according to the present invention will now be described.

Figure 9:
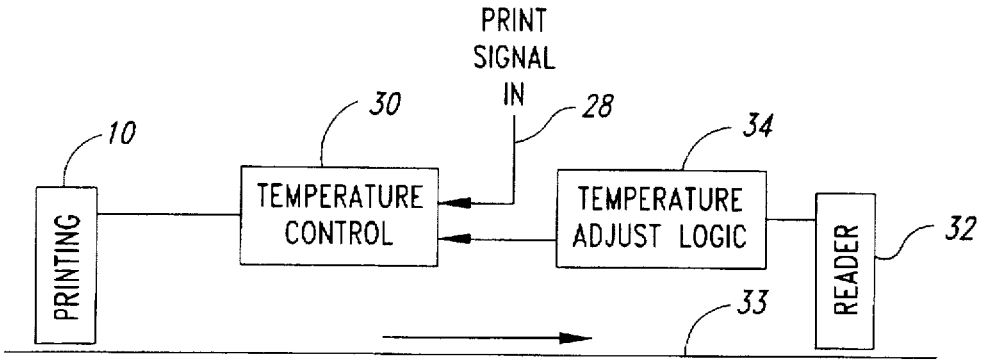
Fig. 9 (PRIOR ART)
FIG. 9 is a simplified drawing of a prior art system for adjusting printhead temperature as a function of print quality.

FIG. 9 depicts a prior art thermal printing system with automatic adjustment of the printing temperature as a function of print quality. The print signal on line 28 passes through a temperature controller 30 which applies the signal to the proper thermal printing elements 12 in the printhead 10 for a time that achieves the desired printing temperature. A reader 32 optically scans the resultant printing on the surface of the media 33 and outputs a signal reflecting the print quality to the temperature adjusting logic 34. Thus, if the printing temperature gets too high and the print quality goes down, the logic 34 inputs an adjusting signal on line 36 to the temperature controller 30 lowering the print temperature. As will be recalled, there are times when a higher print temperature is required such as when poor media is employed. The prior art system of FIG. 9 will not allow the temperature to be increased since to do so would damage the print quality.

Figure 10:
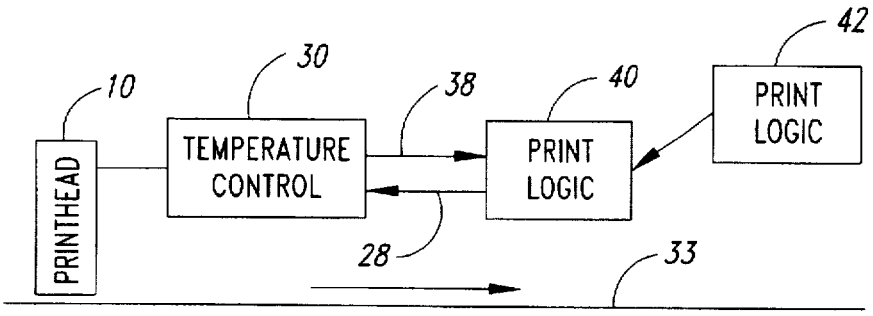
FIG. 10 is a simplified drawing of a system according to the present invention in a first embodiment which adjusts font shaving as a function of printhead temperature.

According to one approach of the present invention as depicted in FIG. 10, there is a feedback signal on line 38 from the temperature controller 30 to the print logic 40 which is outputting the print signal on line 28. As the temperature of the printhead 10 is increased, the print logic 40 selects an appropriate shaved font from the print tables 42 in a manner to be discussed in greater detail shortly. As a result, the print quality at the higher temperate is restored. Thus, unlike the prior art apparatus of FIG. 9, good print quality can be achieved on poor media at the higher temperature required for proper adhesion of the ink to the surface.

Figure 11:
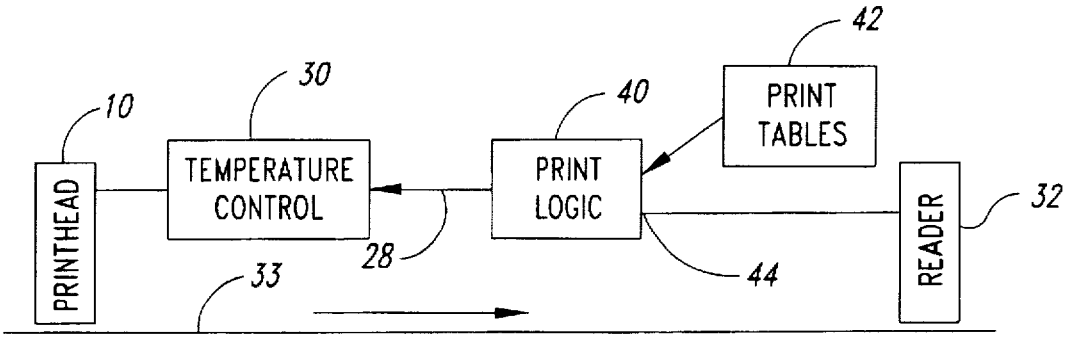
FIG. 11 is a simplified drawing of a system according to the present invention in a second embodiment which adjusts font shaving as a function of print quality.

In a modification of the prior art approach of FIG. 9 as depicted in FIG. 11, the present invention may employ a reader 32 to check the print quality. In this case, however, the output from the reader 32 is fed back to the print logic 40 at input 44. The print logic then uses the print quality signal to select the font to be printed.

Figure 12:
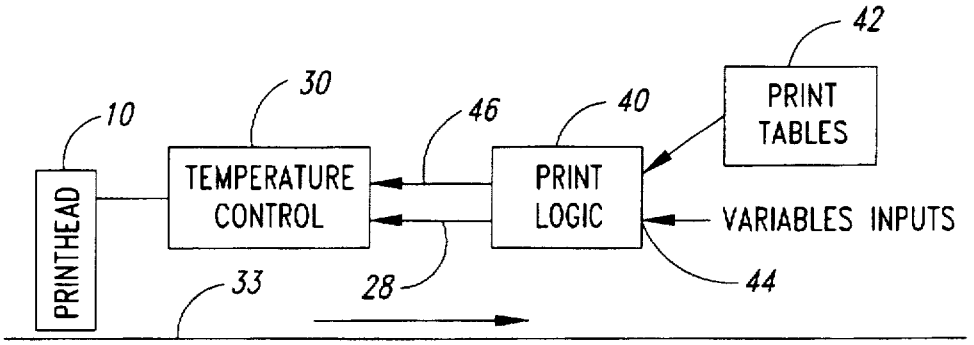
FIG. 12 is a simplified drawing of a system according to the present invention in a third embodiment which adjusts font shaving as a function of other system parameters.

Still another approach according to the present invention is depicted in FIG. 12. This approach could be combined with the print quality reader 32 of FIG. 11 or implemented alone. In this approach, the print logic 40 is provided with inputs of other system variables on input line 44. Such inputs could include system speed, font orientation, media type, ink type, i.e., anything which could affect print quality and require font shaving under certain conditions. The system variables could also be used by the print logic 40 to automatically adjust the temperature controller 30 as necessary using input line 46.

Figure 13:
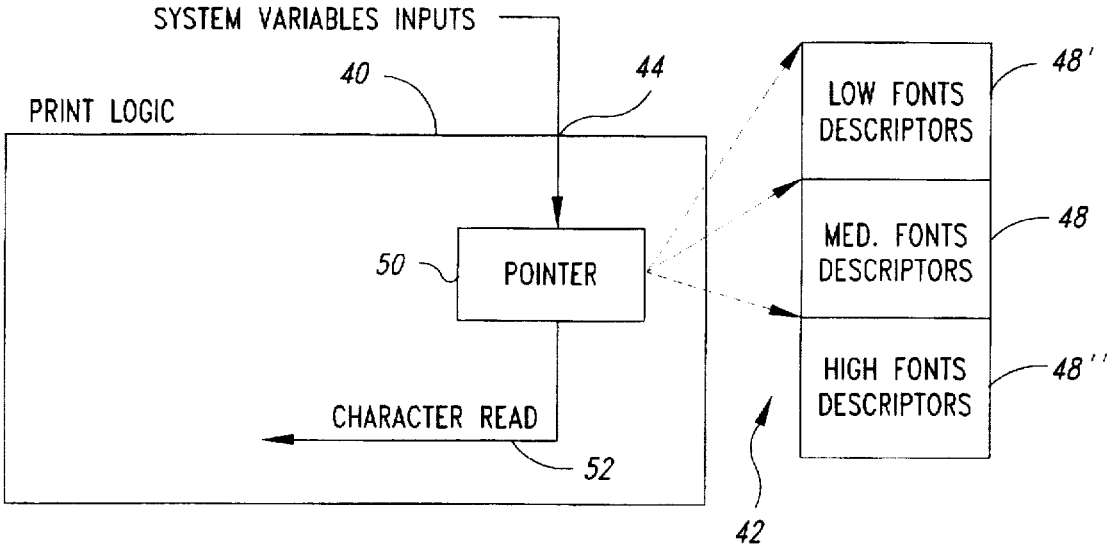
FIG. 13 is a simplified drawing depicting the preferred method of implementing font shaving through selective table look-up.

While font physiology could be calculated in real-time from a basic font definition, the slower computers typically employed in low-cost printers would make such an approach impractical in most cases. Users don't want to wait while their printer "thinks" about what it is going to do. They want to push a button and receive a label immediately. Thus, the table look-up approach depicted in FIG. 13 is the preferred implementation of the present invention. The fonts are pre-defined in computer memory print tables 42. As mentioned earlier, quite often only one row of dots difference may be sufficient to solve any problem. In such case, the tables 42 would contain one set of font definitions 48 for "normal" fonts and one set of font definitions 48' for shaved fonts. For other situations, additional font definitions 48" as necessary could be provided. In a preferred implementation, the print table 42 contains a font definition 48 with no shaving, a font definition 48' with one dot 14 removed, and a font definition 48" with two dots 14 removed. The fonts being used to print are accessed through a pointer 50 which is changed by the print logic 40 as a function of the systems variables inputs at 44 according to techniques well known to those of ordinary skill in the art. In that manner, the accessing of different fonts under different criteria provides no computational time penalty since the character read on line 52 simply uses the pointer 50 as an index into the correct font descriptors in the table 42.

As mentioned earlier and as those of ordinary skill in the art will undoubtedly have recognized from the foregoing description, the techniques of the present invention as described above with particular applicability to thermal printing of dot-oriented materials can easily be adapted to other dot printing devices such as inkjet, bubble jet, and the like. Thus, while the present invention has been described with particular emphasis on a thermal demand label printer, the claims appended hereto are to be accorded a breadth in keeping with the scope and spirit of the disclosure and its various areas of applicability.

Wherefore, having thus described the present invention, what is claimed is:

1. A method of printing font character bars comprised of a plurality of rows which are in turn comprised of a plurality of close adjacent dots to improve print quality and readability thereof by an optical reading apparatus comprising the steps of:

identifying a character bar which is too wide for optimal reading by the optical reading apparatus;

removing at least a portion of at least one dot from a same end of each of the plurality of rows in the identified character bar.

2. The method of claim 1 wherein said step of removing at least a portion of at least one dot from a same end of each of the plurality of rows in the identified character bar comprises the step of:

removing an entire dot from the same end of each of the plurality of rows of the identified character bar.

3. The method of claim 1 wherein said step of removing at least a portion of at least one dot from a same end of each of the plurality of rows in the identified character bar comprises the step of:

removing a plurality of dots from the same end of each of the plurality of rows of the identified character bar.

4. The method of claim 1 wherein the step of identifying a character bar which is too wide for optimal reading by the optical reading apparatus comprises the steps of:

a) monitoring a temperature-producing signal into a printhead printing the font character bars; and, b) indicating the character bar as identified when said temperature-producing signal is above a threshold level.

5. The method of claim 1 wherein the step of identifying a character bar which is too wide for optimal reading by the optical reading apparatus comprises the steps of:

a) optically scanning optical read quality of bars being printed by a printhead; and, b) indicating the character bar as identified when the character bar is too wide for optimal reading by the optical reading apparatus.

6. The method of claim 1 wherein the step of identifying a character bar which is too wide for optimal reading by the optical reading apparatus comprises the steps of:

a) receiving an indication of at least one system variable which influences the print quality being produced by a printhead; and, b) indicating the character bar as identified when the system variable indication is outside of a threshold level.

7. The method of claim 6 and additionally comprising the step of:

modifying temperature-producing signals to the printhead as a function of the system variable indication being received.

8. The method of claim 1 wherein said step of removing at least a portion of at least one dot from a same end of each of the plurality of rows in the identified character bar comprises the steps of:

a) maintaining a table of character font descriptors for a normal set of fonts and a modified set of fonts having at least a portion of at least one dot at the same end of each of the plurality of rows removed;

b) using the font descriptors for the normal set of fonts unless the character bar is identified; and, c) using the font descriptors for the modified set of fonts when the character bar is identified.

9. A method of printing barcode character bars comprised of a plurality of rows which are in turn comprised of a plurality of close adjacent dots to improve print quality and readability thereof by an optical reading apparatus comprising the steps of:

identifying a character bar which is too wide for optimal reading by the optical reading apparatus;

shaving at least a portion of at least one dot from each of the plurality of rows in the identified character bar.

10. The method of claim 9 wherein said step of shaving at least a portion of at least one dot from each of the plurality of rows in the identified character bar comprises the step of:

eliminating a last dot from each of the plurality of rows in the identified character bar.

11. The method of claim 9 wherein said step of shaving at least a portion of at least one dot from each of the plurality of rows in the indentified character bar comprises the step of:

eliminating a last two dots from each of the plurality of rows in the identified character bar.

12. The method of claim 9 wherein the step of identifying a character bar which is too wide for optimal reading by the optical reading apparatus comprises the steps of:

a) monitoring a temperature-producing signal into a printhead printing the barcode character bars; and, b) indicating the character bar as identified when said temperature-producing signal is above a threshold level.

13. The method of claim 9 wherein the step of identifying a character bar which is too wide for optimal reading by the optical reading apparatus comprises the steps of:

a) optically scanning optical read quality of the character bar being printed by a printhead; and, b) indicating the character bar as identified when the character bar is too wide for optimal reading by the optical reading apparatus.

14. The method of claim 9 wherein the step of identifying a character bar which is too wide for optimal reading by the optical reading apparatus comprises the steps of:

a) receiving an indication of at least one system variable which influences the print quality of barcodes being produced by a printhead; and, b) indicating the character bar as identified when the system variable indication is outside of a threshold level.

15. The method of claim 14 and additionally comprising the step of:

modifying temperature-producing signals to the printhead as a function of the system variable indication being received.

16. The method of claim 9 wherein said step of shaving at least a portion of at least one dot from each of the plurality of rows in the identified character bar comprises the steps of:

a) maintaining a table of barcode descriptors for normal barcodes and modified barcodes having at least a portion of a dot at the same end of the plurality of rows shaved;

b) using the normal barcodes unless the character bar is identified; and, c) using the modified barcodes when the character bar is identified.

17. A barcode printer for printing barcode character bars comprised of a plurality of rows which are in turn comprised of a plurality of close adjacent dots with improved print speed capability, print quality, and print readability thereof by an optical reading apparatus comprising:

a) a thermal printhead including a plurality of thermal print elements for printing barcode characters on a media surface;

b) a temperature controller having an input for receiving character-producing commands and an output connected to said thermal printhead for outputting temperature-producing signals to relevant ones of said plurality of thermal print elements; and, c) print logic for outputting character print signals to said input of said temperature controller, said print logic including logic for shaving at least a portion of at least one dot from an end of each of the plurality of rows of a character bar which is too wide for optimal reading by the optical reading apparatus.

18. The barcode printer of claim 17 wherein said logic for shaving at least a portion of at least one dot from an end of each of the plurality of rows of a character bar which is too wide for optimal reading by optical reading apparatus comprises:

logic which outputs character print signals eliminating a last dot from each of the plurality of rows of a character bar which is too wide for optimal reading by the optical reading apparatus.

19. The barcode printer of claim 17 wherein said logic for shaving at least a portion of at least one dot from an end of each of the plurality of rows of a character bar which is too wide for optimal reading by the optical reading apparatus comprises:

logic which outputs character print signals eliminating two last dots from each of the plurality of rows of a character bar which is too wide for optimal reading by the optical reading apparatus.

20. The barcode printer of claim 17 and additionally comprising:

a) circuitry monitoring a temperature-producing signal into said printhead; and, b) logic for removing at least a portion of at least one dot from an end of each of the plurality of rows of all character bars when said temperature-producing signal is above a threshold level indicating that bars too wide for optimal reading by the optical reading apparatus are being printed by said printhead.

21. The barcode printer of claim 17 and additionally comprising:

a) a scanner optically scanning optical read quality of barcodes being printed by said printhead; and, b) logic for removing at least a portion of at least one dot from an end of each of the plurality of rows of all character bars when barcodes with bars too wide for optimal reading by the optical reading apparatus are being printed by said printhead.

22. The barcode printer of claim 17 and additionally comprising:

a) an input to said logic receiving indications of system variables which influence print quality of barcodes being produced by said printhead; and, b) logic for removing at least a portion of at least one dot from an end of each of the plurality of rows of all bars when barcode bars too wide for optimal reading by the optical reading apparatus are being printed by said printhead as a result of said system variables.

23. The barcode printer of claim 22 and additionally comprising:

logic for modifying temperature-producing signals to the printhead as a function of said system variables indications being received.

24. The barcode printer of claim 17 and additionally comprising:

a) a table of barcode descriptors for normal barcodes and barcodes with one less dot and two less dots per row in the bars thereof; and, b) logic for using said descriptors for the normal barcodes when the character bars are not too wide and for using said descriptors for the barcodes with one less dot and two less dots per row when the character bars are too wide by a small amount and a large amount respectively.

* * * * *